US005390739A

United States Patent [19]

Tailby

[11] Patent Number: 5,390,739

[45] Date of Patent: Feb. 21, 1995

[54] HYDRAULIC TOOL AND HYDRAULIC PRESSURE DEVICE

[75] Inventor: Roger Tailby, Ålgård, Norway

[73] Assignee: Den Norske Stats Oljeselskap A.S, Stavanger, Norway

[21] Appl. No.: 59,333

[22] Filed: May 11, 1993

[30] Foreign Application Priority Data

May 13, 1992 [NO] Norway ..... 92.1898

[51] Int. Cl.[6] ..... E21B 23/04

[52] U.S. Cl. ..... 166/212; 166/217; 166/383

[58] Field of Search ..... 166/381, 383, 212, 217, 166/332

[56] References Cited

U.S. PATENT DOCUMENTS

| | | | |
|---|---|---|---|
| 3,378,080 | 4/1968 | Fredd | 166/381 X |
| 3,646,996 | 3/1972 | Pearce, Jr. | 166/212 |
| 3,863,715 | 2/1975 | Yonker | 166/217 |
| 4,378,839 | 4/1983 | Fisher, Jr. | 166/217 |
| 4,862,958 | 9/1989 | Pringle | 166/72 |
| 4,986,362 | 1/1991 | Pleasants | 166/382 |
| 5,029,642 | 7/1991 | Crawford | 166/72 |

*Primary Examiner*—David J. Bagnell

*Attorney, Agent, or Firm*—Foley & Lardner

[57] ABSTRACT

Hydraulic tool for carrying out relative axial movements in an oil or gas well by means of hydraulic pressure through a hollow tubing string, comprising a cylindrical tool housing and axially movable cylinder-piston members in the housing. There are provided concentric, hollow cylinders (20,30) each being separately movable axially in said housing (10), and an inner piston (40) being axially movable within an adjacent cylinder (30). Breakable retaining elements (31,32) keep said inner piston (40) and said adjacent cylinder (30) in an initial position until said retaining elements are overcome by the hydraulic pressure. Thrust dogs (21,22) cooperate with recesses (88) in a surrounding tubing component (80) where axial movement of said outer cylinder (20) causes radial expansion of said thrust dogs (21,22), by means of conical surfaces (23) on said outer cylinder (20). A spring (27) acts against said axial movement of the outer cylinder (20) to return the cylinder to its initial position upon termination of the hydraulic pressure. Projecting members (29,18 and 62,66) of at least one cylinder (30) and said inner piston (40) are pushed out of said housing (10) by sequential exposure to said hydraulic pressure, for carrying out a sequence of relative axial movements.

16 Claims, 6 Drawing Sheets

HYDRAULIC TOOL AND HYDRAULIC PRESSURE DEVICE

Figure 1:
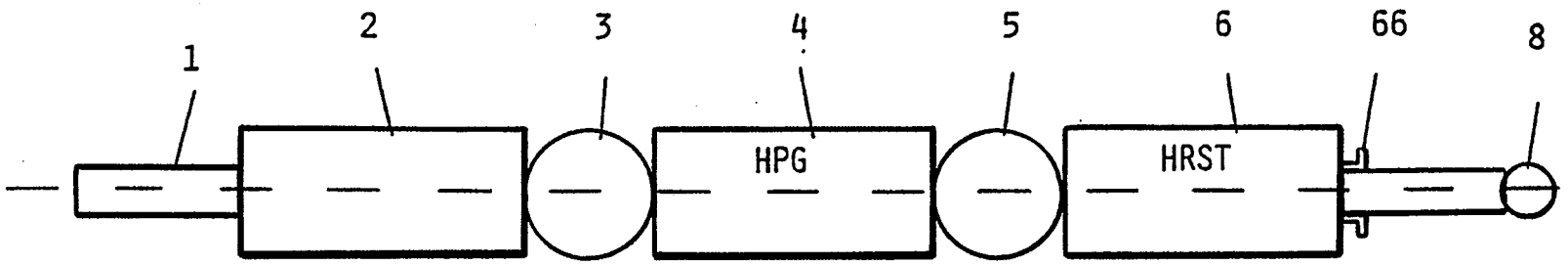

This invention generally concerns tools for generating axial force at the bottom of an oil or gas well by hydraulic pressure through the bore of a coiled tubing string. The technique is especially suitable for horizontal or highly deviated wells.

Oil and gas wells are usually maintained by wireline techniques. One of these techniques involves the generation of force along the well's axis by impact jarring. This force actuates mechanical tools in order to set or release locking elements or shift sleeves up or down. Such techniques are well known to those skilled in the art.

These useful techniques are not readily available for horizontal wells. All wireline operations rely on gravity, both for transport to the desired location at the bottom of the well and for generating jarring forces. Coiled tubing may be used to a certain extent, but a long horizontal well will result in severe buckling of the coiled tubing, thereby increasing wall friction with the well's production tubing or casing and reducing the axial force that can be applied at the bottom to set locks or move sleeves.

Prior art of interest to this invention may be seen to describe some of the individual features as employed also in the combination being characteristic to the present tool, and in this regard the following patent publications are referred to:

Norwegian patent 161.136 shows a production safety valve held in position by locking or anchoring elements being moved radially by camming action from an axially displaceable cylinder, and the tool for actuating them.

U.S. Pat. Nos. 3,646,996 and 3,863,715 relate to devices or tools for similar purposes. However, locking or anchoring elements as in the above Norwegian patent specification, are employed.

None of these three patents relate to devices run on and actuated through coiled tubing, and all three devices require a specialized well completion.

British patent application 2.236.550 describes a shifting tool run by coiled tubing into a well, for performing functions somewhat corresponding to those contemplated by the present invention. This known shifting tool involves successive and repeated impact application steps, the shifting length being determined by a corresponding number of shear pins.

U.S. Pat. No. 4,862,958 is more interesting since it is based on the use of coiled tubing, and is directed to generating axial force by means of hydraulic pressure applied through the coiled tubing. However, no sequential operation is described, and the coiled tubing necessary is of an unusual type, being equipped with a second internal conduit.

U.S. Pat. No. 4,986,362 may perhaps be considered as the most interesting of the prior art referred to here, since a two-step cylinder-piston function is described, involving shear pins, with hydraulic pressure applied through coiled tubing. The operation depends on the application of two different and predetermined pressures, and shifting of a sleeve is not included in the device's abilities. Considerable tension must be applied at the bottom of the coiled tubing, in order to release the tool. This may not be possible in a horizontal well.

The purpose of the present invention is to provide an improved tool for generating axial force in a horizontal or highly deviated well using the hydraulic pressure that can be applied through coiled tubing or the like. This force for example, will allow locks to be set and sleeves to be shifted in the same operation by the tool. The operational sequence which results is entirely automatic, with no further action from the operator at the surface, and no feedback from the tool itself. Additionally, the invention provides for emergency release of the tool alone or the entire toolstring involved under conditions which preclude correct operation.

Thus, in oil or gas wells containing a sliding sleeve nipple into which a choke valve, for example, is to be set, the shifting of the sleeve and the setting of the valve can be carried out by utilizing the present hydraulic tool powered by hydraulic pressure applied through the coiled tubing. Moreover, the automatic sequence of operations is guarded against incorrect operation due to unfavourable circumstances, by comprising emergency features or sequences allowing the tool or the entire toolstring connected thereto, to be safely retrieved to the surface.

It is also an objective of this invention to allow use of the tool with both conventional coiled tubing and the Coiled-Tubing-Assisted Pumpdown (CTP) technique. To that end, the components of the tool-are joined with swivel balls, and are themselves of a length which will allow passage around the radius of surface piping, e.g. a 5-foot radius. Also, since the method of tool transport by the CTP technique involves internal coiled tubing pressure, a shear-pinned hydraulic power generator is included in order to avoid unintentional actuation. The particular hydraulic power generator employed in this connection, constitutes an additional aspect of the present invention.

For this invention to be applied in actual practice, it is usually necessary that a special sliding sleeve be installed in the well. The special design of such sliding sleeve is described further below. A typical operation in this sliding sleeve might be the insertion of a choke valve for control of fluid production through the sliding sleeve. This involves locating the toolstring, shifting down the sleeve in order to open it, setting a lock mandrel in a profile in the sliding sleeve nipple, and releasing and retrieving the setting tool to the surface. All of these tasks are performed by wireline, coiled tubing and other conventional techniques in normally deviated wells.

On the above background this invention provides an improved tool and a hydraulic power generator, the novel and specific features of which are stated in the claims.

Figure 11:
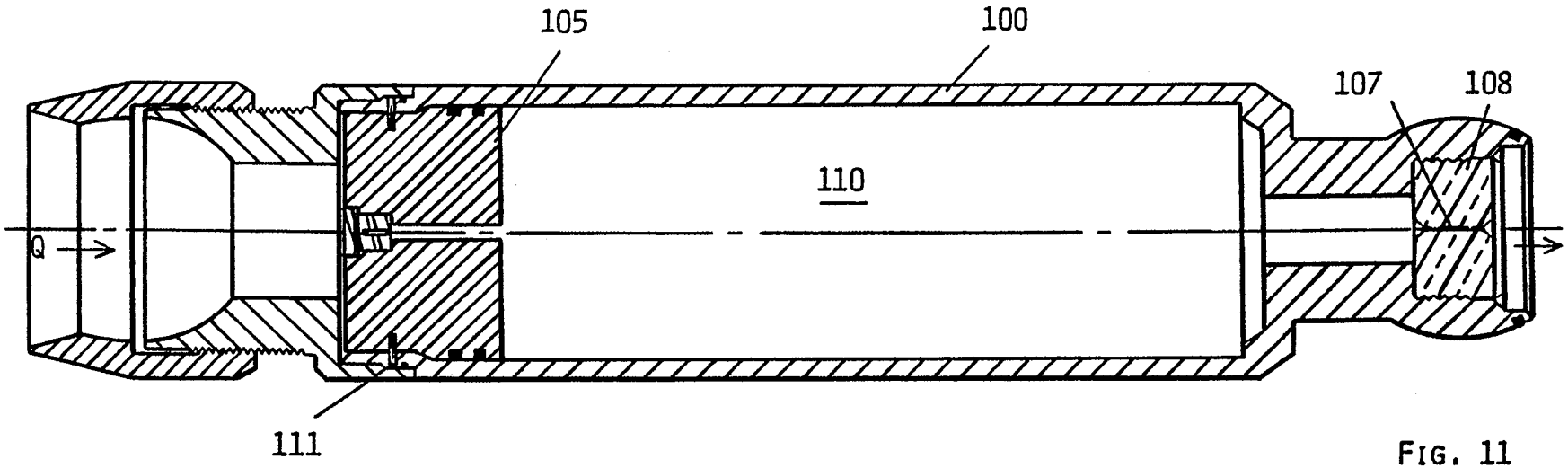
Figure 2A:
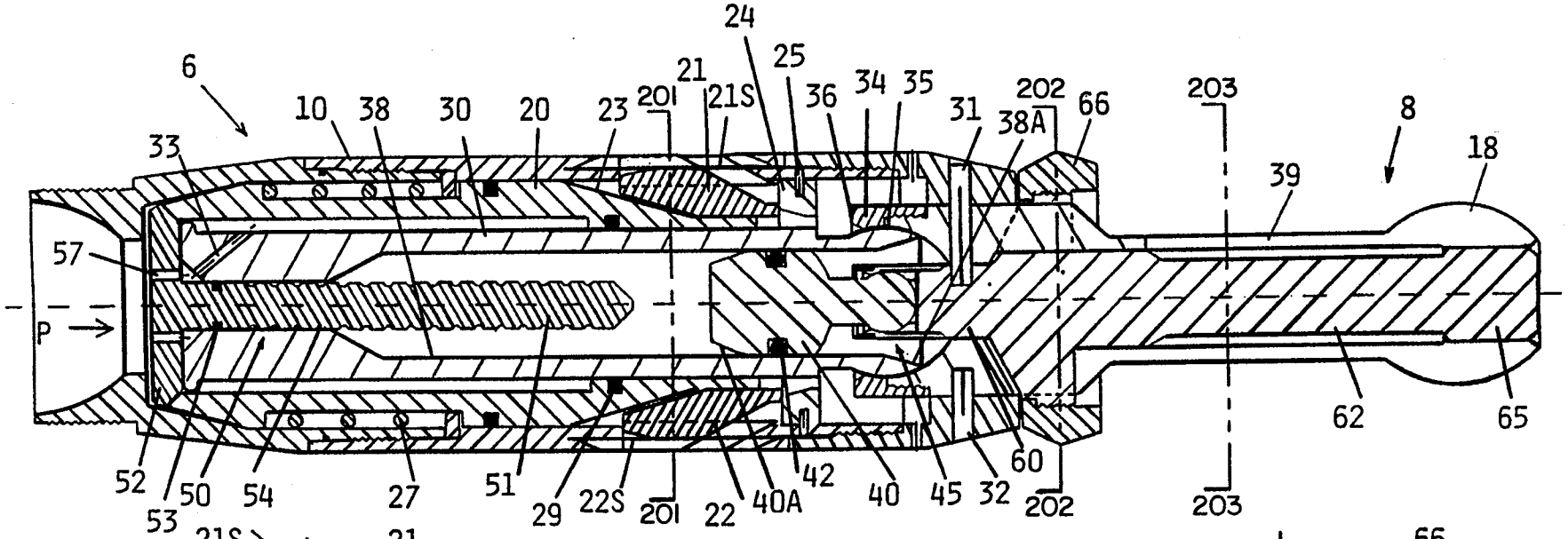
Figure 2D:
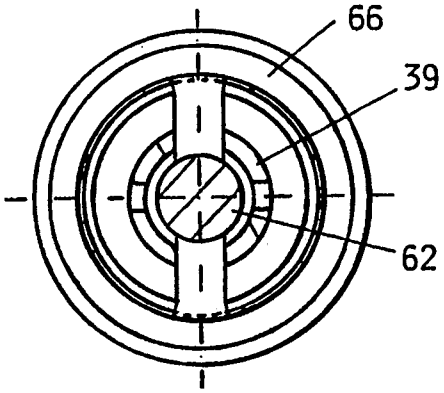
Figure 2C:
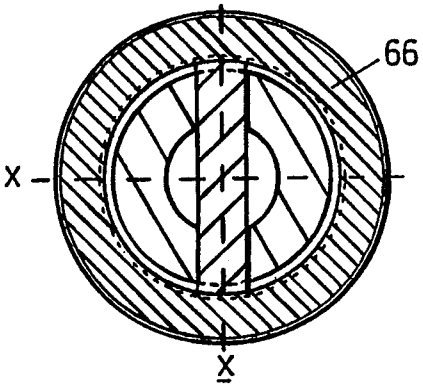
Figure 2B:
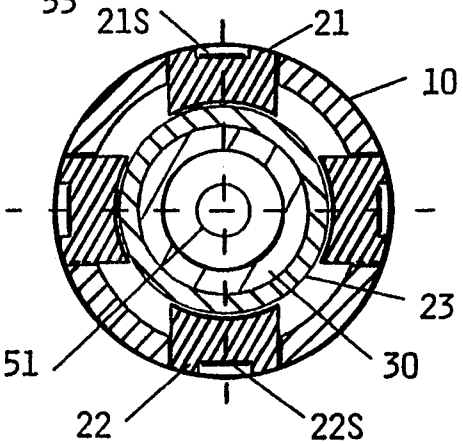
Figure 3:
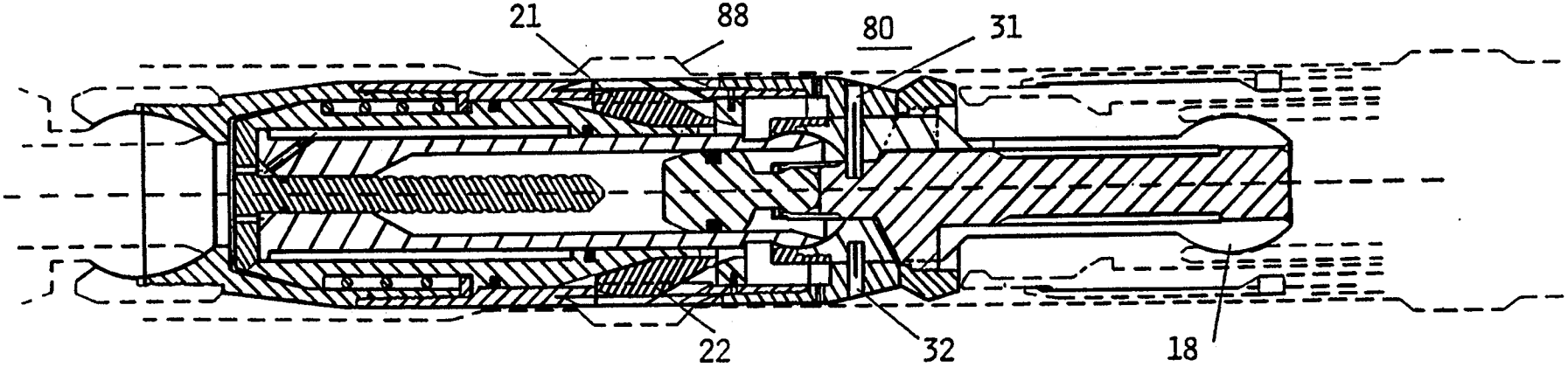
Figure 4:
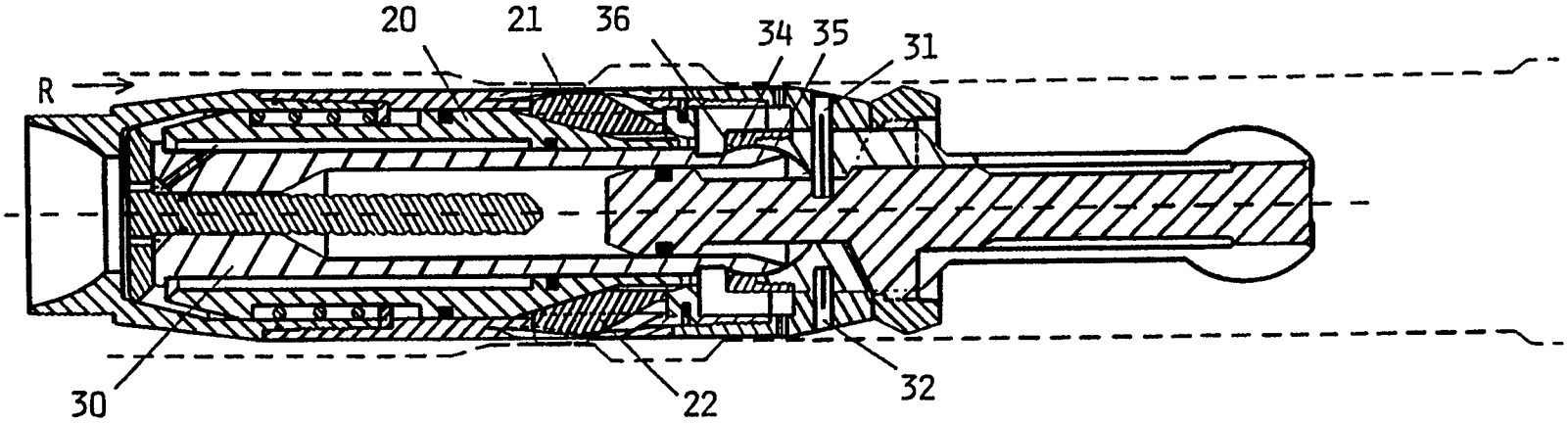
Figure 5:
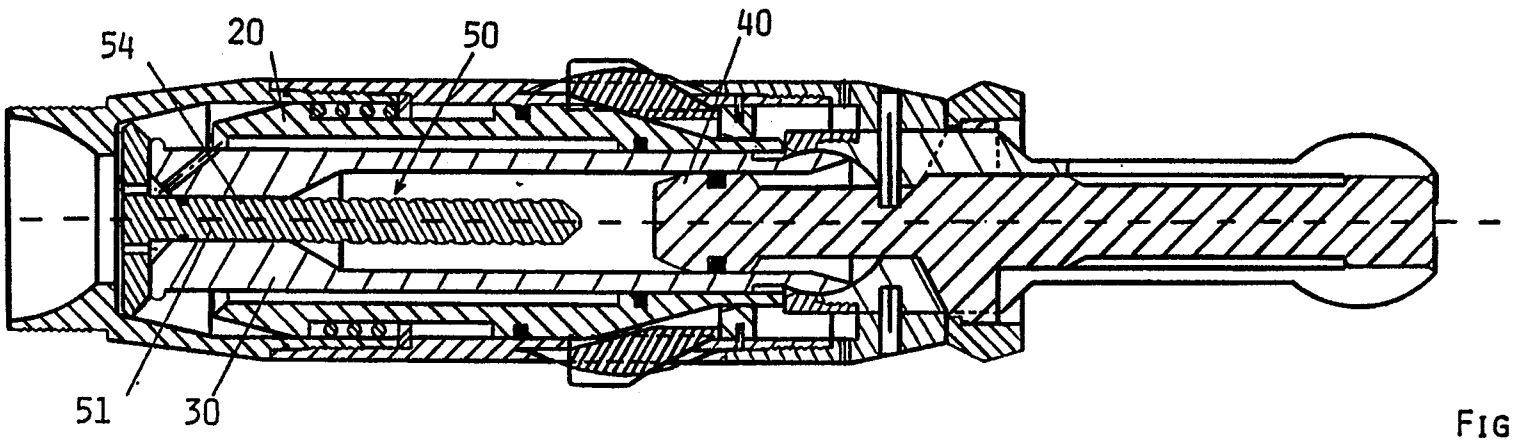
Figure 6:
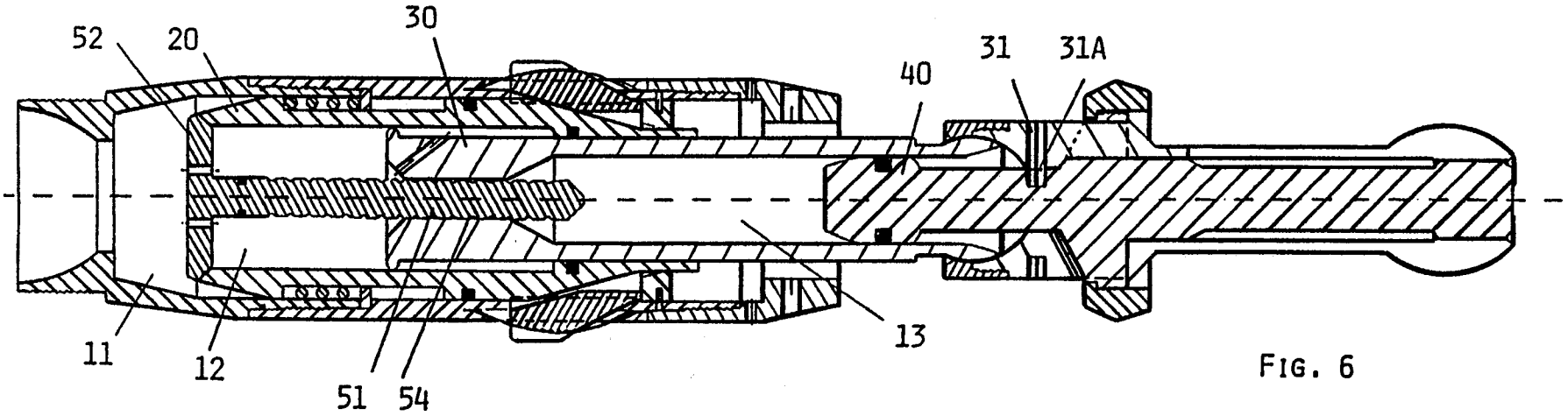
Figure 7:
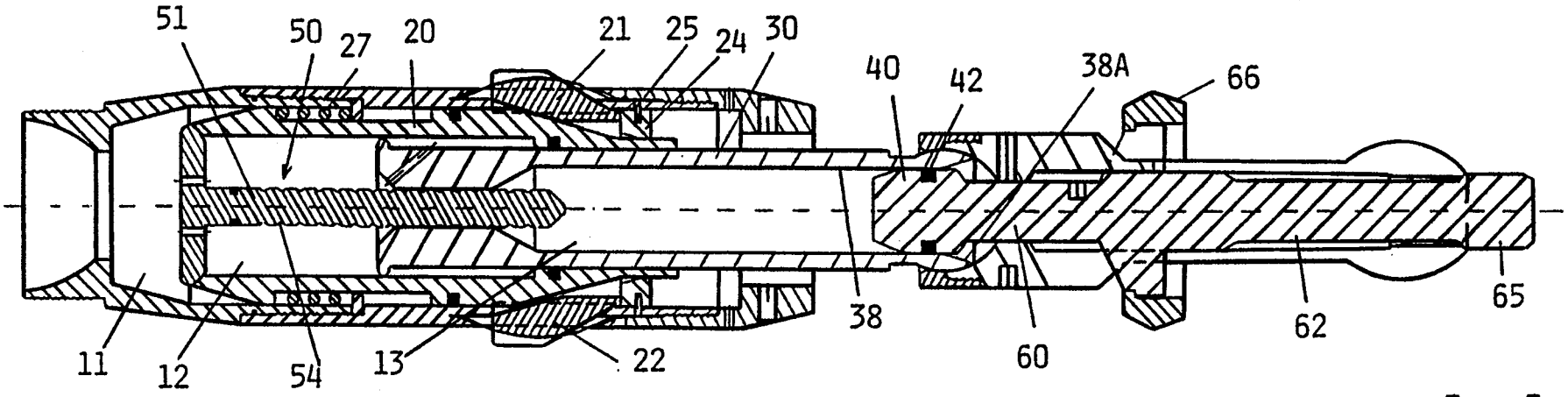
Figure 8:
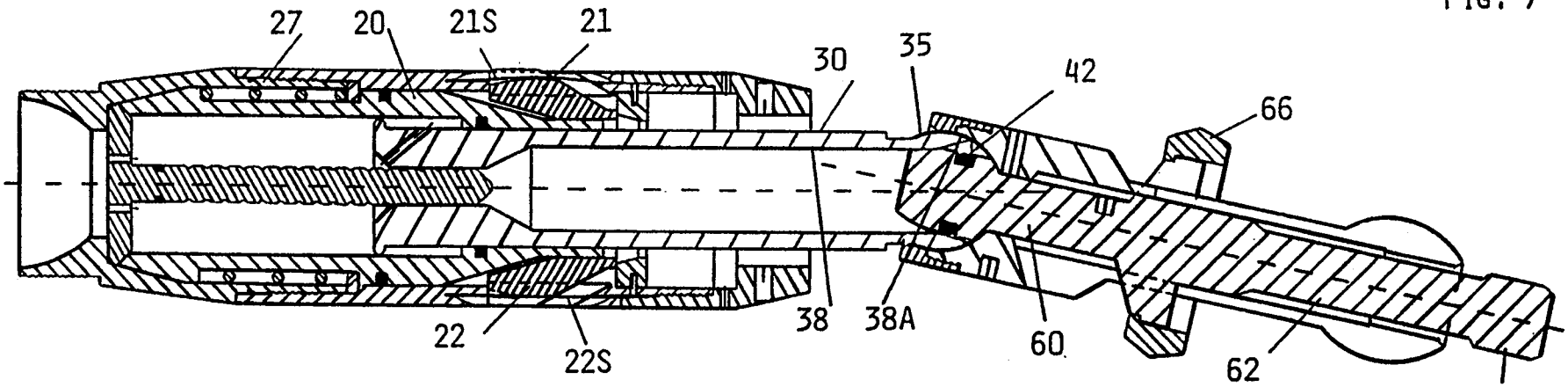
Figure 9:
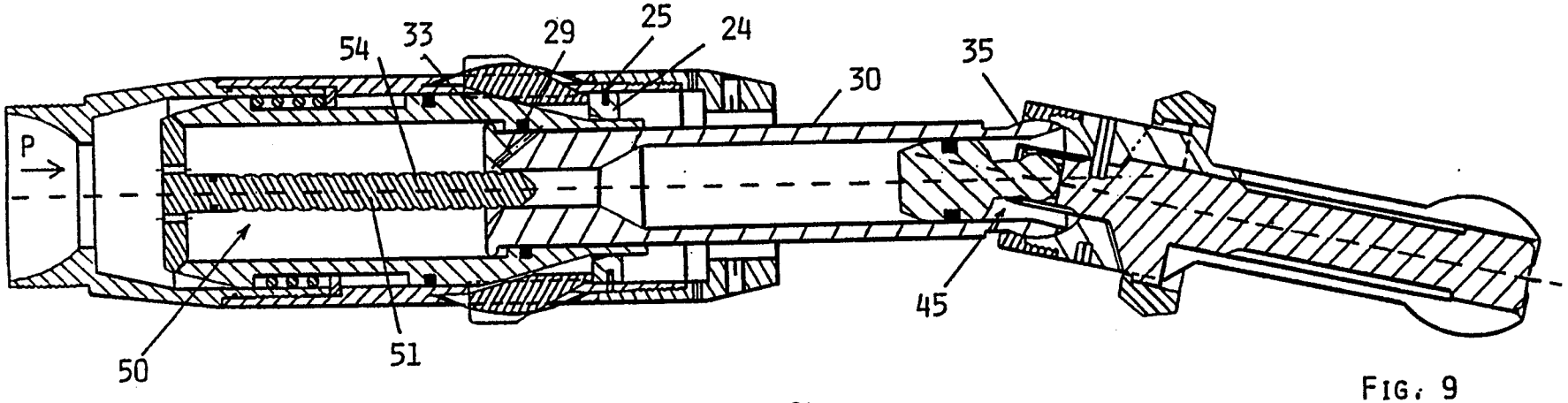
Figure 10:
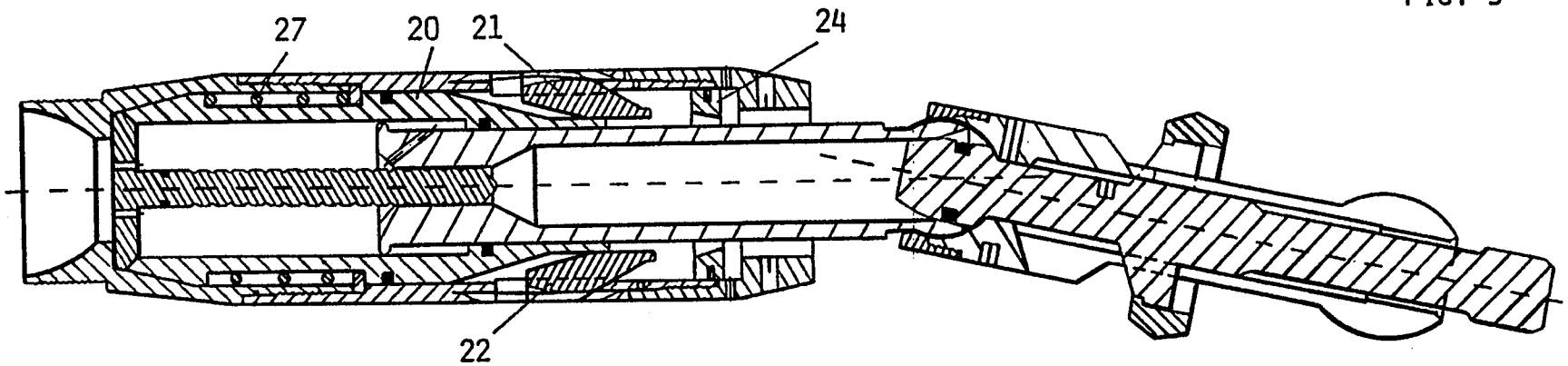

In the following description the invention is explained more in detail, including the operation of the tool and associated hydraulic power generator, with reference to the drawings, in which:

FIG. 1 schematically shows a string of main components comprising a coiled tubing connector, a hydraulic power generator (HPG) and a hydraulic running and setting tool (HRST) according to the invention, FIG. 2A in axial section shows the tool (HRST) in an embodiment according to the invention, ready to be connected to the rest of the toolstring, FIGS. 2B, C and D show cross-sectional views at various points 201, 202, 203, respectively as indicated in FIG. 2A, FIG. 3 shows the HRST tool of FIGS. 2A–D when located in a special sliding sleeve nipple where a lock is to be set and the sleeve shifted open, FIG. 4 shows a situation when the tool is not located properly and pressure actuates the HRST tool, FIG. 5 shows the HRST tool when correct actuation is initiated and its thrust dogs are expanded into their correct anchoring profile, FIG. 6 shows the HRST tool during actuation of the sliding sleeve, FIG. 7 shows the HRST tool after lock setting when all functions have been correctly completed, FIG. 8 shows the HRST tool flexing while being withdrawn from the well, FIG. 9 shows a situation where the sliding sleeve has not been properly shifted, and the tool actuating pressure has been dumped, FIG. 10 shows a situation where the thrust dogs do not release correctly and a dog support ring has to be sheared for emergency release, and FIG. 11 in axial section shows the hydraulic power generator in its initial condition.

As shown in FIG. 1 the whole string assembly consists of the coiled tubing 1, whether run conventionally from the surface or as part of a pumpdown toolstring, a hollow connector 2 terminating in a swivel ball joint 3, the hydraulic power generator 4, and the HRST tool 6 itself, with a swivel ball joint 5 also inserted between the power generator 4 and the tool 6. Extending to the right side of the tool 6 there are shown projecting toolstring actuation members 66 and 8. The latter is indicated as a swivel ball joint or connection to a toolstring or components to be operated upon by the tool 6, as for example to be set in a sliding sleeve at the bottom of an oil or gas well. Details of such a sliding sleeve and toolstring are shown in FIG. 3, and shall be explained below.

The hydraulic power generator 4 is shown more in detail in FIG. 11, and basically comprises a cylinder 100 with a piston 105 inside, for separating the fluid in the coiled tubing 1 from a filling of particular hydraulic fluid in a volume 110 within cylinder 100 in front of the piston 105, being shown in its initial position in FIG. 11. Arrow Q indicates the pressure exerted by the fluid in the coiled tubing 1, and arrow P at the opposite end of the hydraulic power generator indicates the same pressure finally applied to the running and shifting tool 6. The reason for establishing such separation by means of hydraulic power generator 4 is the risk of having impurities or particles contained in the coiled tubing fluid, introduced into the interior of the running and shifting tool 6, with possible undesired effects on the operation thereof. Piston 105 in power generator cylinder 100 is initially held by shear pins 111 in its starting position, thus necessitating a fluid pressure Q of a certain magnitude in order to break the shear pins 111 and start its movement towards the right-hand end of cylinder 100. Such movement will press the hydraulic fluid in cylinder 100 through a metering opening 107 in an end plug 108, whereby the rate of supply of such hydraulic fluid exerting the pressure P in the tool 6, may be controlled and optimised for different well conditions.

The hydraulic running and setting tool 6 as shown in detail in FIG. 2A with accompanying cross-sectional views in FIGS. 2B, 2C and 2D, consists basically of three concentric hydraulic chambers 11, 12 and 13 as shown more clearly in FIG. 7 (after normal operation). It should be noted in this connection that the axial section in FIG. 2A is taken at a right angle as indicated with X—X in FIG. 2C. Moreover, when comparing FIG. 2A with FIGS. 4, 5, 6, 7, 8 and 10, the latter figures have been somewhat simplified by not showing in detail a ball joint 45 found in FIG. 2A (and in FIG. 9).

The three basic and concentric hydraulic chambers 11, 12 and 13 (see FIG. 7) mentioned above, are provided for by the following three main components being axially movable within an outer cylindrical housing 10 of the tool 6:

Firstly, an outer hollow cylinder 20.

An intermediate hollow cylinder 30 being axially movable within the outer cylinder 20.

An inner piston 40 being axially movable within the intermediate cylinder 30.

Various seals, such as seals 29 and 42 are provided between the relatively movable cylinder and piston components. In the initial condition of the parts as shown in FIG. 2A, shear pins 31 and 32 serve to retain the intermediate cylinder 30 and the inner piston 40 in their positions as shown, in relation to each other and to housing 10. In this embodiment shear pin 31 has a dual function, first to keep the intermediate cylinder 30 in its fixed, initial position within housing 10, and then at another shear point to secure the initial relative axial position of the inner piston 40 within the intermediate cylinder 30. As will be understood from the following description the break points or shear functions provided for in combination by shear pins 31 and 32 can be obtained with only one shear pin or by three or more shear pins in a suitable arrangement.

The outer cylinder 20 is designed with conical surfaces 23 adapted to engage anchoring elements or so-called thrust dogs 21 and 22 upon axial displacement of cylinder 20 towards the right in FIG. 2A, thereby pressing dogs 21 and 22 radially outwards so as to enter into profiles, recesses or the like in a surrounding tubing component. As shown with dotted lines in FIG. 3 such component may be a tubing part 80 in which a recess 88 is formed for this purpose. As further shown in FIG. 2A leaf springs 21S and 22S may be associated with each dog 21 and 22 respectively, for bringing these back to their retracted position shown in FIG. 2A, after actuation and upon movement of the outer cylinder 20 back to its initial position as shown in FIG. 2A.

The cross-sectional view of FIG. 2B shows that four anchoring or thrust dogs are arranged at regular intervals around the circumference of housing 10 and protruding through respective openings therein. Of course the number of such dogs may be different from what is shown in the present embodiment. The inner or right-hand end faces of dogs 21 and 22 as shown in FIG. 2A, abut against a support ring 24 being connected to housing 10 by shear pins 25. A helical spring 27 will be compressed when the outer cylinder 20 is moved in the right-hand direction in FIG. 2A.

The intermediate cylinder 30 is slidable within the outer cylinder 20, the right-hand or inner portion of which has an inner diameter corresponding to the outer diameter of the intermediate cylinder 30. A seal 29 engaging cylinder 30 is mounted in an internal groove in cylinder 20.

Cylinder 30 protrudes through an inner open end of cylinder 20 and is provided with a ball joint head 35 for connection to actuating members projecting out of the tool housing 10. Such members connected to the intermediate cylinder 30 comprise a ball joint cap 34 with an end or abutment face 36, a shank 39 and a ball or head 18 at the extreme right-hand end of this member.

This is the preferred embodiment for setting locks described in Norwegian patent 161.136 and U.S. Pat. Nos. 3,646,996 and 3,863,715. However, other actuating members for setting different locks by the same action are also possible.

The outer cylinder 20 is also open at its left-hand or outer end in FIG. 2A with respect to the hydraulic fluid flow or pressure P acting thereon. Thus, an end piece or plate 52 of a plug member 50 does not sealingly engage this end of cylinder 20. Through end plate 52 there are even provided bores 57 admitting hydraulic pressure to act on the intermediate cylinder 30. From the outer end face of the latter there is moreover a bore 33 extending to a point inwardly at the outer cylindrical surface of the cylinder, and this bore 33 performs a safety function in connection with seal 29. This function will be explained further below.

Along a major portion of the length of the cylinder 30 an internal cylindrical cavity 38 receives the inner piston 40 with its seal 42. Cavity 38 is open at the inner or right-hand end of cylinder 30 in FIG. 2A with a widened mouth at 38A. At the opposite end of cylinder 30 there is a bore for a shaft 51 of the isolation or restriction plug 50, this shaft being provided with a seal 53. Because of this seal 53 hydraulic pressure P will not be admitted to cavity 38 to act on piston 40 in the relative position of the parts as shown in FIG. 2A. However, the length of shaft 51 extending inwardly through a portion of the bore in the intermediate cylinder 30 and into the cavity 38, has flow labyrinths 54 for example in the form of circumferential grooves around the shaft. As described below these labyrinths will admit a restricted flow of hydraulic fluid into cavity 38 upon a relative axial movement of cylinder 30 and isolation plug 50.

Whereas the above description with reference to FIGS. 2A–D has been directed to the structural details of the present hydraulic running and shifting tool, the operation thereof will be explained in the following with particular reference to FIGS. 3–10, illustrating various steps and situations which may occur during such operation. In the list of figures given above, these steps and situations have been briefly indicated.

Starting from the initial position as illustrated by FIG. 2A, the operation takes place as follows:

The outer cylinder 20 is actuated first by pressure P from the hydraulic power generator 4 (FIG. 1), and expands the thrust dogs 21, 22 laterally with the conical wedge surfaces 23. These dogs engage in the profile recess 88 in the special sliding sleeve 80 (FIG. 3) and provide a base for the subsequent setting and shifting actions of the tool.

If the thrust dogs 21, 22 for some reason are not allowed to expand beyond a predetermined limit, the outer cylinder 20 will not stroke far enough to contact the cap abutment face 36 of the ball joint 34–35 on the intermediate cylinder 30 extension. The actuating pressure P on the intermediate cylinder alone is not sufficient to shear the pins 31, 32 restraining it, and the actuating cycle does not continue. Upon reversing the pressure R (FIG. 4) on the outer cylinder 20, the whole toolstring may be removed from the well intact.

If the tool is correctly positioned and the thrust dogs 21, 22 are free to expand into their recess profile 88, the outer cylinder 20 will stroke enough to push on the cap face 36 of the ball joint 34–35 on the intermediate cylinder extension with a force which, when added to the hydrostatic force on the intermediate cylinder 30, is enough to shear the pins 31, 32 restraining the intermediate cylinder and initiate the sleeve shifting process.

Since pressure P is still being applied from the power generator 4, the intermediate cylinder 30 will start to stroke immediately the pins 31, 32 shear. At this time (FIG. 5), the isolation plug 50 is still fully inserted into the intermediate cylinder 30, and the actuating pressure P is isolated from the inner piston 40. However, during the stroke of the intermediate cylinder 30, the isolation plug 50 is held up by the outer cylinder 20, thus allowing actuating pressure to the inner piston 40 via the labyrinth 54 on the outside of the shaft 51 of the isolation plug 50 (FIG. 6). If the stroke length of cylinder 30 is too short, the plug will not be retracted and the inner piston 40 will not be activated.

The function of the intermediate cylinder 30 is to push down on the entire toolstring, reacting against the thrust dogs 21, 22 expanded in their profile 88 (FIG. 3). With dotted lines in FIG. 3 the component or components to be maneuvered are shown, with a coupling to end ball or head 18 in extension of the intermediate cylinder 30. Such components to be actuated may comprise a shifter mandrel and a sliding sleeve to be shifted.

In the situation (FIG. 9) where the stroke of the intermediate cylinder 30 is too long to be compatible with correct operation of the sliding sleeve, for example if locating keys have slipped past their profile instead of shifting the sleeve, the actuating pressure P will dump through the bleed-off bore 33 which will have moved past the outer cylinder seal ring 29. The lock will subsequently not be set and the toolstring will be retrieved still connected to the tool. The ball joint 45 on the inner piston 40 will be concentric with the ball joint 35 on the intermediate cylinder extension, allowing sufficient flexibility to retrieve the tool through surface piping.

Because the labyrinth 54 on the shaft 51 of the isolation plug 50 retards the buildup of pressure above the inner piston 40, this does not experience full actuating pressure until the intermediate cylinder 30 has completed its stroke and the lock mandrel, for example, is correctly positioned. When this pressure finally builds up, it shears the inner part 31A of pin 31 and releases the inner piston 40. The inner piston is connected to shaft 60 which carries thrust collar member 66, and as it strokes out, the thrust collar 66 causes the required actuation, such as setting the lock mandrel by expanding lock dogs into their profile (FIG. 7). This action is common to a variety of different lock designs, and the device may therefore be adopted to these other designs.

Simultaneously with the setting action, a nose 65 at the end of shaft extension 62 is forced out from under the collets which hold the tool connected to the lock mandrel. These collets are now free to collapse, thereby releasing the tool from the set toolstring.

At the extremity of the stroke of the inner piston 40, the actuating pressure is dumped when the O-ring 42 leaves the cavity bore 38 of the intermediate cylinder 30, and enters the widened mouth 38A. With actuating pressure P released, the spring 27 outside the outer cylinder 20 will force it back up again and the leaf springs 21S, 22S will retract the thrust dogs 21, 22 into the body of the tool. The tool may then be retrieved from the well. Flexibility of the extended tool is ensured by the ball joint 35 on the intermediate cylinder extension (FIG. 8).

If the release of the thrust dogs 21, 22 is hindered for some reason, an upward pull with the coiled tubing 1 will press the dogs against the dog support ring 24.

Provided that the outer cylinder 20 has been retracted by its spring 27, pins 25 holding the dog support ring 24 in place will be loaded and will shear, allowing the ring 24 to move downward and providing a space for the thrust dogs to retract into (FIG. 10). The tool is then free to be retrieved from the well.

It can be seen that the complete actuation cycle with the addition of the various emergency release mechanisms, is an automatic process built into the tool design and requiring no manipulation of the coiled tubing, variation of the applied pressure in the coiled tubing or knowledge of the current state of the tool.

I claim:

1. Hydraulic tool for automatically carrying out a sequence of relative axial movements in an oil or gas well by the application of a hydraulic pressure through a hollow tubing string run into horizontal or highly deviating well portions, comprising;

a cylindrical tool housing, at least one concentric, hollow cylinder separately movable axially in said housing, an inner piston axially movable within an adjacent cylinder, retaining elements adapted to keep said inner piston and said adjacent cylinder in an initial position mutually and in relation to said housing until said retaining elements are overcome by the hydraulic pressure, anchoring elements with associated openings in said housing for cooperation with recesses, an outer cylinder provided with conical surfaces facing outwardly, whereby an axial movement of said outer cylinder under the influence of the hydraulic pressure is adapted to cause radial expansion of said anchoring elements by means of said conical surfaces, a spring acting against said axial movement of the outer cylinder and serving to return the cylinder to an initial position upon termination of the application of hydraulic pressure, springs acting against said radial expansion of the anchoring elements and serving to press the anchoring elements back radially inwards upon the return of said outer cylinder, and parts of at least one of said cylinders and said inner piston, projecting out of said housing for carrying out said sequence of relative axial movements.

2. Hydraulic tool according to claim 1, wherein said adjacent cylinder is an intermediate cylinder between said inner piston and said outer cylinder, an abutment face is on said intermediate cylinder, positioned such that said outer cylinder, upon a certain radial movement of said anchoring element, is adapted to engage said abutment face on said intermediate cylinder, and together with the intermediate cylinder to exert a sufficient axial force for overcoming one of said retaining elements between said housing and said intermediate cylinder, with a resulting movement of said intermediate cylinder under the influence of the hydraulic pressure.

3. Hydraulic tool according to claim 2, wherein said abutment face is rigidly connected to said intermediate cylinder.

4. Hydraulic tool according to claim 2, wherein said abutment face is integral with said intermediate cylinder.

5. Hydraulic tool according to claim 1, further comprising plug means restricting the supply of hydraulic fluid through said adjacent cylinder to the inner piston, said plug means being adapted to be changed from a completely closed position to a restricted, open position, upon a certain relative axial movement of said adjacent cylinder in relation to said outer cylinder, so that the hydraulic pressure has access to and displaces said inner piston.

6. Hydraulic tool according to claim 5, wherein said plug means comprises a shaft member for cooperation with an axial bore in the outer end of said adjacent cylinder, and groove means along a portion of said shaft member adapted to form a labyrinthine flow path through said axial bore, with a resulting delay in the supply of hydraulic fluid to said inner piston.

7. Hydraulic tool according to claim 1, wherein an axial inner portion of said outer cylinder is provided with a sealing element for sealing against said adjacent cylinder and said adjacent cylinder is provided with a through-going bleed hole so arranged that hydraulic pressure release takes place when an inner end of said bleed hole is moved past said sealing element.

8. Hydraulic tool according to claim 1, further comprising a support ring for inner ends of said anchoring elements, said support ring being fixed in said housing by means of further breakable retaining elements.

9. Hydraulic tool according to claim 1, wherein said adjacent cylinder is connected to first associated projecting parts through a first ball joint.

10. Hydraulic tool according to claim 9, where said inner piston is connected to second associated projecting parts through a second ball joint which at least in an initial position has a center of rotation coinciding with the center of said first ball joint.

11. Hydraulic tool according to claim 1, wherein an outer end of the tool housing is provided with a coupling ball joint for coupling to the lower end of the hollow tubing string.

12. Hydraulic tool according to claim 1, wherein an outer end of the tool housing is provided with a coupling ball joint for coupling to a component on the lower end of the hollow tubing string.

13. Hydraulic tool according to claim 1, wherein an outer end of the tool housing is provided with a coupling ball joint for coupling to a device on the lower end of the hollow tubing string.

14. Hydraulic tool according to claim 1, wherein the retaining elements are breakable.

15. Hydraulic tool according to claim 1, wherein the retaining elements are spring loaded.

16. Hydraulic tool according to claim 1, further comprising:

a cylinder part and an axially movable piston within the cylinder part, wherein said axially movable piston is adapted to separate between fluid supplied through said hollow tubing string and a hydraulic fluid in said cylinder part, and to be retained in an initial position in said cylinder part by means of breakable retainers, that said axially movable piston delivers hydraulic fluid to at least one of said cylinders during axial movement of said axially movable piston upon breaking of said retainers as a result of exertion of a sufficiently high pressure through said hollow tubing string, and ball joints for mechanical interconnection at both ends of said cylinder part, one of said ball joints connected to said tool housing.

* * * * *